US005683280A

United States Patent [19]

Winner

[11] Patent Number: 5,683,280

[45] Date of Patent: Nov. 4, 1997

[54] ANTI-VENTILATION DEVICE FOR SAILBOARDS

[75] Inventor: William K. Winner, P.O. Box 1127, White Salmon, Wash. 98672

[73] Assignees: Eric Edgar Voight, Hood River, Oreg.; William K. Winner

[21] Appl. No.: 664,143

[22] Filed: Jun. 14, 1996

[51] Int. Cl.[6] ..... B63B 1/00

[52] U.S. Cl. ..... 441/79; 114/140

[58] Field of Search ..... 441/74, 79; 114/39.2, 114/140

[56] References Cited

U.S. PATENT DOCUMENTS

| | | | |
|---|---|---|---|
| 3,902,207 | 9/1975 | Tinkler et al. . | |
| 3,988,794 | 11/1976 | Tinkler et al. . | |
| 4,493,665 | 1/1985 | Liddle | 441/79 |
| 4,537,143 | 8/1985 | Gaide | 114/39 |
| 4,850,917 | 7/1989 | Wilson et al. | 441/79 |
| 5,022,337 | 6/1991 | Caldwell | 114/39.2 |
| 5,038,698 | 8/1991 | Winner | 114/39.2 |
| 5,148,761 | 9/1992 | Winner | 114/39.2 |

FOREIGN PATENT DOCUMENTS

| | | | |
|---|---|---|---|
| 2668747 | 5/1992 | France | 441/74 |
| 3246126 | 6/1984 | Germany | 441/79 |

OTHER PUBLICATIONS

Aero–Hydrodynamics of Sailing; C. A. Marchaj, Dodd, Mead & Company, 1979, pp. 53 and 67.

Sailing Yacht Design; Robert G. Henry and Capt. Richards T. Miller, Cornell Maritime Press, Inc. Cambridge, Maryland, 1965, pp. 612–613.

*Primary Examiner*—Jesus D. Sotelo

*Attorney, Agent, or Firm*—Flehr Hohbach Test Albritton & Herbert LLP

[57] ABSTRACT

A sailboard or surfboard (30) having a fin (32) and a skirt (36) extending aft of the tail edge (34) of the board. The skirt (36) is mounted to the sailboard in a manner so that the skirt assumes the contour of the water when sailed. Adhesive or a clamp plate is utilized to secure the skirt (36) to the board (30). The fin (32) includes a fin base (60) and a foil (62). Foil (62) is positioned aft of the fin base (60) so that the trailing edge (64) of the foil (62) is aft of the fin base (60).

12 Claims, 5 Drawing Sheets

Fig. 5
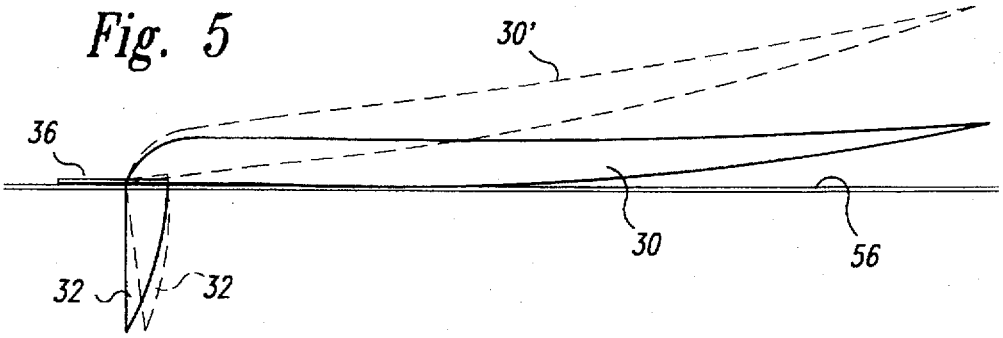
Fig. 2
(PRIOR ART)
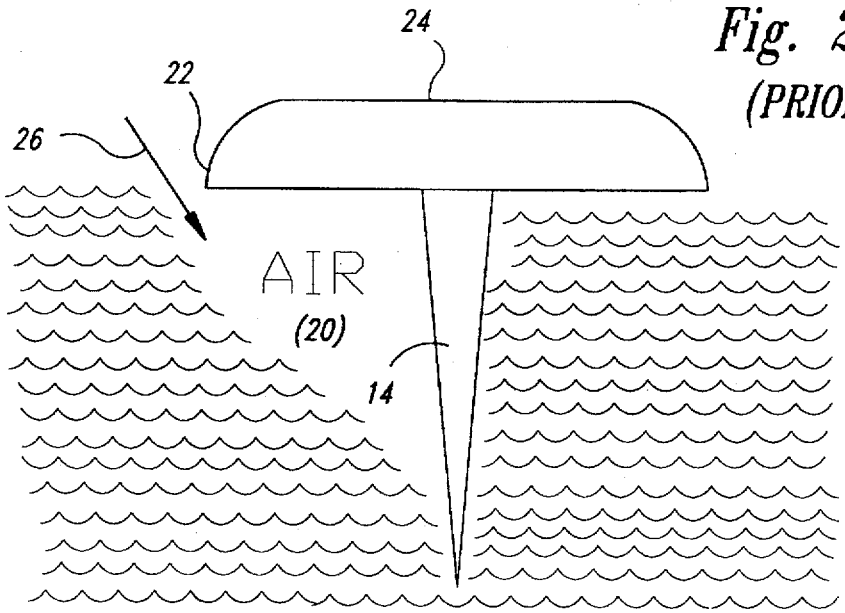
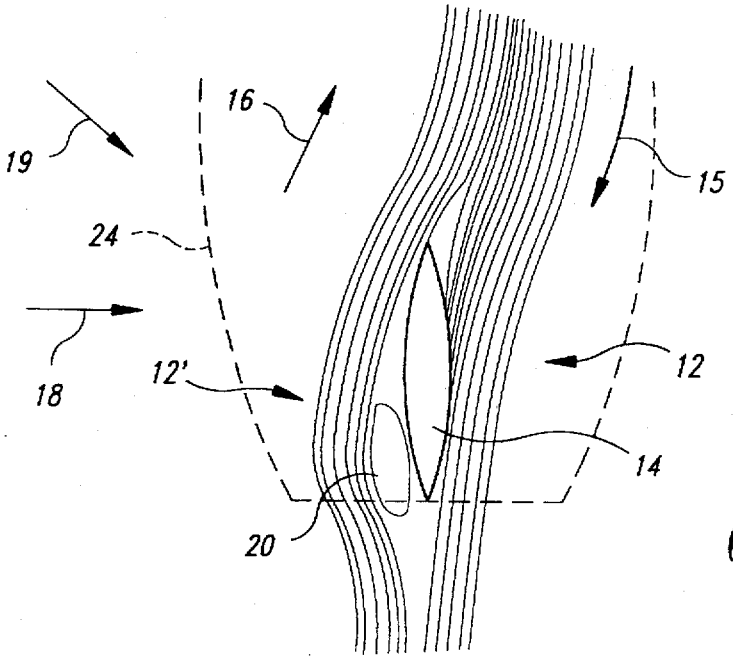
Fig. 1
(PRIOR ART)

ANTI-VENTILATION DEVICE FOR SAILBOARDS

TECHNICAL FIELD

The present invention relates to sailboards and, more particularly, to an improved sailboard design.

BACKGROUND OF THE INVENTION

In the sport of windsurfing, the phenomenon of "ventilation" has limited the speed and controllability of sailboards. Ventilation is the entrainment of surface air down across the fin of a sailboard. As shown schematically in FIGS. 1 and 2, lines 12 represent the flow of water past a fin 14, in the direction of arrow 15. Arrow 16 represents the direction of travel of fin 14 and sailboard 24. Arrow 18 represents the true wind direction and arrow 19 represents the apparent wind direction. As the fin moves through the water, a low pressure area 20 is created on the windward side of fin 14. As a windsurfer sails across the water, the flow path 12' of the water accelerating around fin 14 becomes more curved, which creates low pressure area 20.

At a certain speed and sailing direction, low pressure area 20 will achieve a pressure sufficiently low to draw air from the surface of the water spanwise down across the fin. This is known as ventilation. Surface air is drawn past the edge 22 of the sailboard 24, as shown by arrow 26, into low pressure region 20. When ventilation occurs, atmospheric pressure fills region 20, and destroys the lateral lift generated by the fin. While the potential for ventilation decreases at higher speeds due to the higher flow rate of water past the fin, ventilation potential is not significantly reduced or eliminated.

Ventilation prevents windsurfers from sailing a reach that is too "close" for a given speed. As a windsurfer sails on a tack that is more and more into the wind, the potential for ventilation increases, and should ventilation occur, the result is a spin out. A spin out is the loss of lift in the fin of the sailboard, which causes loss of speed and controllability.

One of the primary sailboard design criteria for minimizing ventilation is to position the fin inwardly and forwardly from the trailing edge of the sailboard hull. Fins are generally positioned about four inches from the trailing edge. This increases the distance that surface air must travel to reach the fin, which reduces potential for ventilation. However, ventilation is still a common problem.

Contrary to this design criteria, fins have been repositioned back into close proximity of the trailing edge of a sailboard hull. Moving the fin, as well as the footstraps and mast track, as far aft as possible has the potential of significantly increasing the speed and controllability of sailboards. However, such sailboards typically have severe ventilation and spin out problems.

U.S. Pat. No. 5,022,337, of Caldwell, entitled "Lift Producing Device Exhibiting Low Drag and Reduced Ventilation Potential and Method for Producing the Same," discusses several different proposed solutions for minimizing ventilation. Starting in column 6, on line 17, with reference to FIGS. 5 and 6, Caldwell discusses providing a cutout in the skeg (fin) and shows a cutout 32 in FIG. 5A. Caldwell also mentions the provision of a forefin (FIG. 5B), a bump on the leading edge near the root of the fin or a vortex off the tip of a forefin (not shown), fences (FIG. 5C), a slot in the fin (FIG. 6A) and tandem fins (FIG. 6B). Caldwell states that the problem with these existing methods of preventing ventilation is higher drag, a known disadvantage in high speed racing.

Other solutions to the problem of ventilation include providing the fin with a forward sweep, which tends to keep ventilation confined to the root area of the fin, shaping the fin with a narrow root section and a wide lower section, and providing a sharp leading edge along the root section of the foil. The present invention is designed to avoid the detrimental performance effects of these prior art solutions, while still achieving significant reductions in ventilation.

DISCLOSURE OF THE INVENTION

Briefly described, the invention comprises the provision of a skirt or flap at the tail edge of a sailboard or surfboard. The skirt extends aft of the tail section of the board and is mounted to the bottom of the hull at the tail section of the hull. By significantly reducing ventilation, the skirt allows the fin to be positioned closer to the tail edge of the board.

Preferably, the skirt is flexible so that it can ride along the surface of the water as the pitch of the sailboard changes as the sailboard moves across the water. The skirt should also have sufficient strength to prevent ventilation in the region of the fin. That is, the skirt should be structurally rigid enough to prevent surface air from getting sucked down the low pressure side of the fin.

The present invention allows the trailing edge of the root of the fin to be positioned approximately three inches or less from the tail edge of the hull of the sailboard. Preferably, the trailing edge of the fin is at or close to the tail edge of the board. The skirt has sufficient surface area, i.e. depth and width, that the trailing edge of the root of the fin is no closer than approximately three inches from the trailing edge of the skirt.

Preferably, the skirt is substantially flush with the bottom surface of the hull. The skirt does not impede the flow of water past it, but rather assumes the contour the water would take were the skirt not there. This does not increase the hydrodynamic drag across the bottom surface of the sailboard.

According to an aspect of one embodiment of the invention, the hull includes a notch at its tail edge. The notch receives the forward edge portion of the skirt for mounting the skirt to the hull. The skirt is secured to the hull by means of an adhesive and in a manner that the skirt is substantially flush with the bottom surface of the hull.

According to an aspect of another embodiment of the invention, the notch is larger in depth and a clamp plate is provided for clamping the forward edge portion of the skirt to the hull. The clamp plate sized to fill the portion of the notch not filled by the forward edge portion of the skirt, so that the clamp plate is substantially flush with the bottom surface of the hull. A clamp plate provides for easy replacement of the skirt should the skirt get damaged or worn out.

According to an aspect of another embodiment of the invention, the hull includes a slot adjacent its tail edge. The forward edge of the skirt is provided with an elongated bead and the slot receives the bead. In this manner, the skirt is held in the slot due to friction between the two and due to the force of the water against the underside of the skirt.

According to an aspect of the invention, the tail section of the hull is substantially squared off. With this design, the skirt is shaped in a manner that the trailing edge of the skirt continues the contours of the rails of the hull.

According to another aspect of the invention, the fin includes a fin base and a foil and the hull includes a fin box slot for receiving the fin base and securing the fin to the hull. The root of the foil extends aft of the back edge of the fin base, i.e. is off-set aft of the fin base. Preferably, the root of the foil extends aft of the fin base to approximately the tail edge of the hull. This fin design allows the skirt of the present invention to be used with existing boards. A notch is cut out or machined out of the tail edge of a conventional sailboard and the skirt is secured at the notch by adhesive or a clamp plate, or other conventional method. The off-set fin repositions the fin adjacent the tail edge of the board, thus increasing speed and controllability of the sailboard.

These and other features, advantages and objects of the present invention will become apparent from the following detailed description when read with the accompanying drawings and the claims, which are all incorporated herein by reference.

BRIEF DESCRIPTION OF THE DRAWINGS

Like reference numerals are used to indicate like parts throughout the various figures of the drawing, wherein:

FIG. 1 is schematic view of a conventional sailboard illustrating the phenomena of ventilation that is a problem for existing boards;

FIG. 2 is a schematic end view of a conventional sailboard, further illustrating ventilation;

FIG. 5 is a side view of the sailboard of FIG. 3 shown in a first position with the nose of the board close to the water and in a second position with the board pitched up;

BEST MODE FOR CARRYING OUT THE INVENTION

Figure 3:
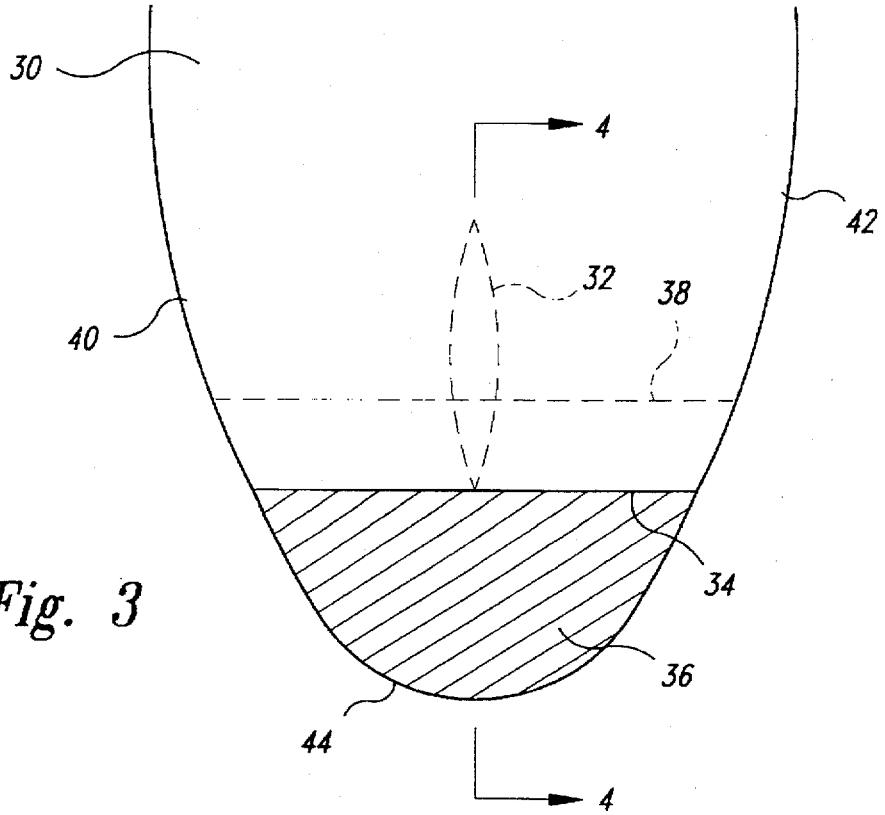
FIG. 3 is a plan view of the tail section of the sailboard of the present invention.

Referring to the drawings, FIG. 3 shows a plan view of the tail section of a sailboard hull 30. A fin 32 is shown in dashed lines. The tail section of board 30 has a squared-off tail edge 34. A flexible, plastic skirt or flap 36 is mounted at the tail edge of board 30. Skirt 36 extends underneath the tail section a short distance and its forward edge 38 (shown in dashed lines) terminates approximately a quarter to a third of the way into fin 32. The contours of rails 40, 42 of board 30 are continued by the trailing edge 44 of skirt 36. In this manner, the plan view outline of sailboard 30 is similar to conventional sailboard designs, but the construction is quite different.

Figure 4:
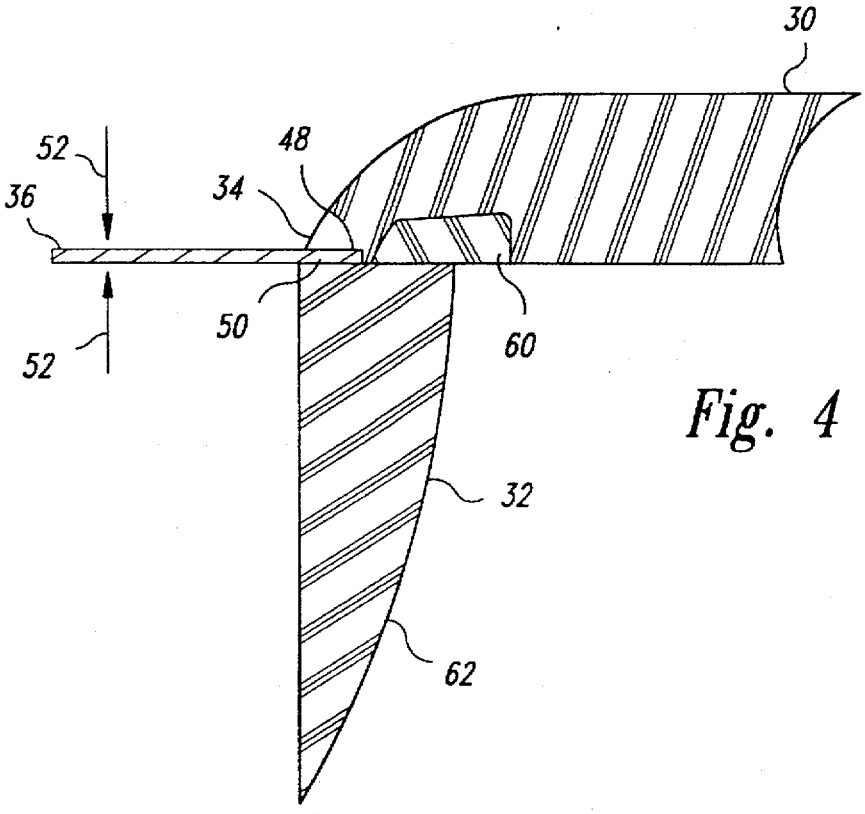
FIG. 4 is a sectional view, taken along the lines 4—4 of FIG. 3.

FIG. 4 is a sectional view of the sailboard tail section of FIG. 3. The sailboard hull 30 includes a notch 48 on its under side and at its tail edge 34. The forward portion 50 of skirt 36 is positioned in notch 48 and can be secured to hull 30 by means of adhesive. Arrows 52 indicate the thickness of skirt 36, which thickness preferably is less than 3 millimeters. Ultimately, however, the thickness of skirt 36 is dictated by the material chosen for the skirt.

The skirt can be made of any number of flexible plastic materials. The material should have sufficient strength so that it can be securely attached to the tail edge of a sailboard. If an adhesive bond is used to secure the skirt to the sailboard, the skirt material has to be capable of being thoroughly bonded to typical board-building materials such as epoxy and ASA. The skirt should also have good ultra-violet resistance, since it will spend a lot of time in the sun. The skirt material should also be tough enough to resist the typical use and abuse that sailboard equipment is designed for. An eighth-inch thick, medium density polyurethane sheet material may be suitable for the skirt. Testing to date has indicated that a thick mylar sail material works well.

Skirt 36 should be rigid enough to prevent surface air from moving downward along fin 32. In other words, skirt 36 should have sufficient strength so that it does not excessively bend in response to the suction forces created by the low pressure region on the windward side of fin 14.

Skirt 36 should also have sufficient flexibility so that it can bend relative to board 30 as board 30 moves across the water. This is shown in FIG. 5. In the position of sailboard 30 shown in solid lines, the board 30 is riding close to the water line 56 and skirt 36 assumes the contour of the water line. In the position of board 30' shown in dashed lines, the board is pitched upwardly and a significant portion of the under side of the hull of board 30' is up off of the water. In this position, skirt 36 flexes in response to the movement of board 30 and maintains its contour on water line 56. In this manner, skirt 36 does not cause the nose of the board to pitch downward or otherwise negatively affect the performance of the board. FIG. 5 is meant to illustrate a board 30 moving up and down as it would when sailed in windy conditions where the surf is up or the water is choppy.

Figure 6:
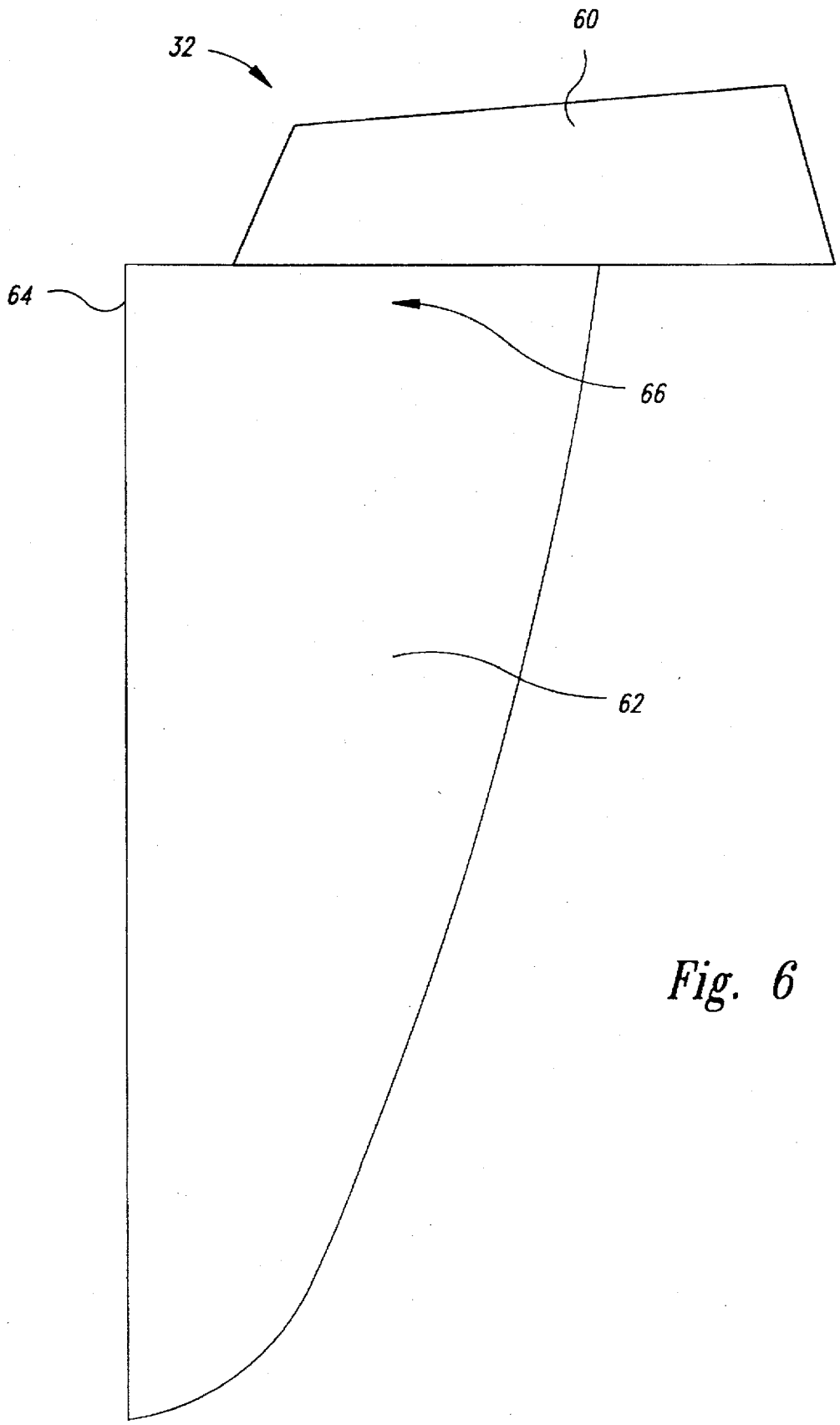
FIG. 6 is an enlarged side view of a fin base and foil for the sailboard of FIG. 3.

FIG. 6 is an enlarged side view of fin 32. Fin 32 includes a fin base 60 and a foil 62. The design of fin base 60 can be any of several conventional fin base designs used in sailboard manufacturing. Likewise, the shape of foil 62 can be any desired shape and curvature. With a preferred embodiment of the present invention, foil 62 is offset from fin base 60 so that the trailing edge 64 of the root portion 66 of foil 62 extends aft of fin base 60. This allows trailing edge 64 to be positioned at the tail edge 34 of board 30. This design is shown in FIG. 7.

Figure 7:
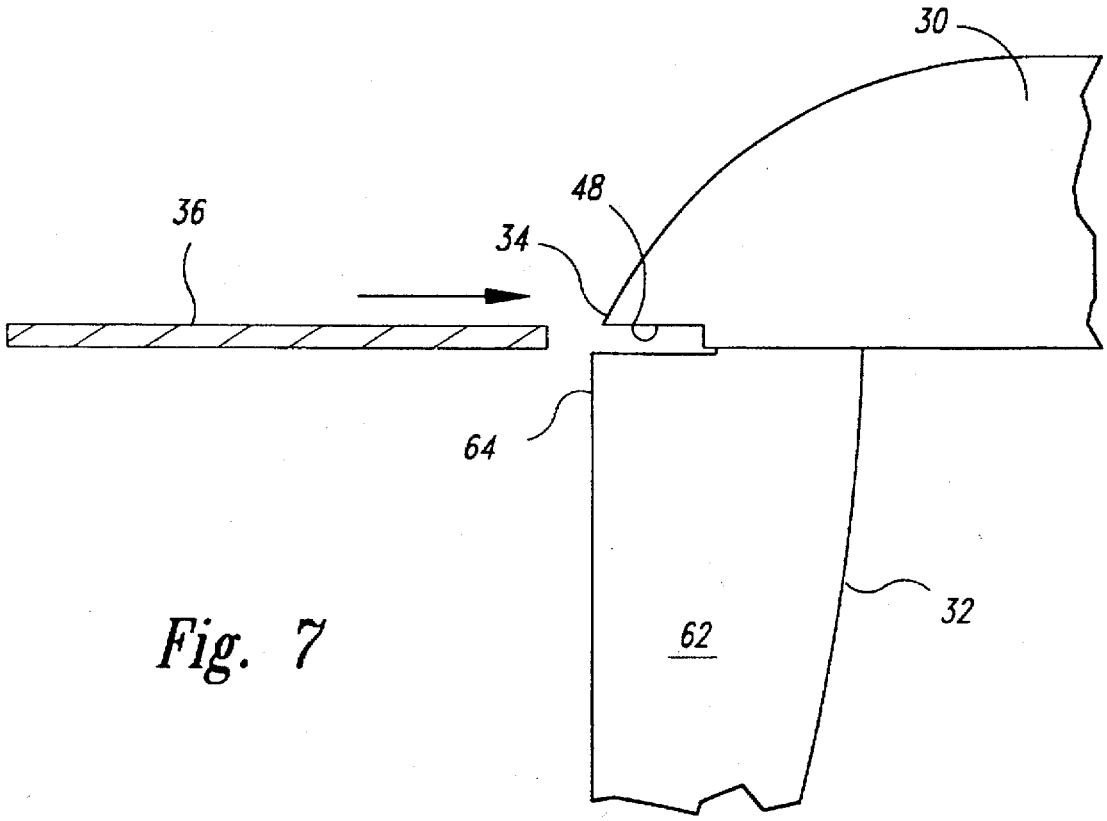
FIG. 7 is an enlarged side view of the tail section of the sailboard of FIG. 3, shown with the skirt exploded.

FIG. 7 also illustrates a first preferred method of securing skirt 36 to board 30. A suitable adhesive is applied to the under side of notch 48 and skirt 36 is positioned in notch 48 and secured thereto. Preferably, this is done without fin 32 mounted to the hull. After skirt 36 is secured to the hull, fin 32 can be mounted in its fin box and the assembly is complete.

Figure 8:
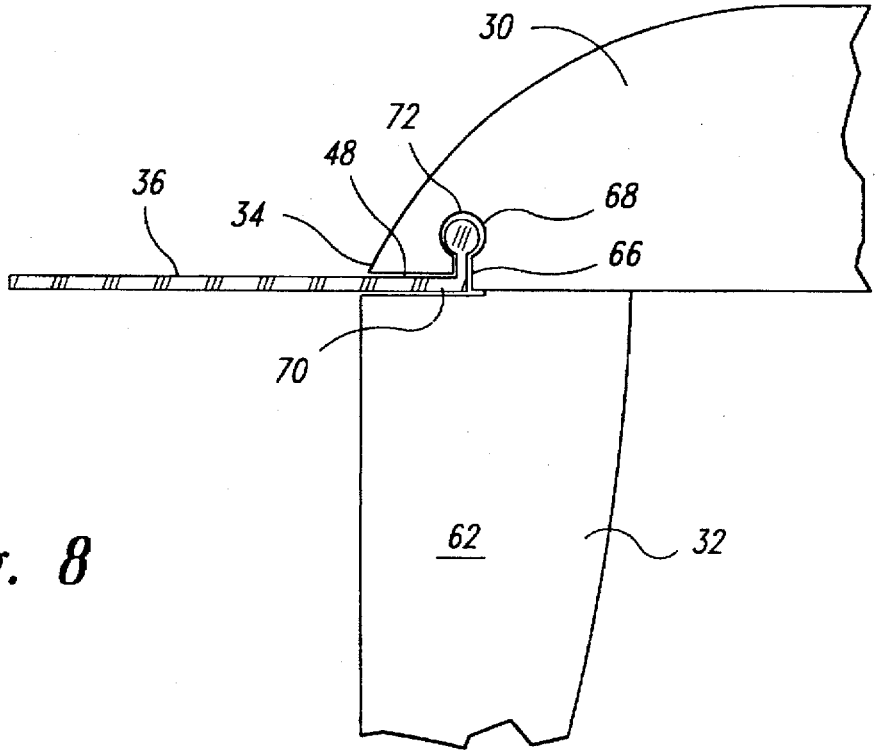
FIG. 8 is an enlarged side view of the tail section of FIG. 3, with an alternative design shown for mounting the skirt to the hull of the sailboard.

FIG. 8 shows a second alternative design for securing skirt 36 to board 30. The hull 21 of board 30 is provided with a laterally-extending slot 66 having an enlarged inner end 68. The forward end of skirt 36 includes a right angle portion 70 and a bead 72. Right angle portion 70 and bead 72 are sized to closely fit within slot 66 and notch 48, preferably so that friction forces keep the skirt within the slot.

Figure 9:
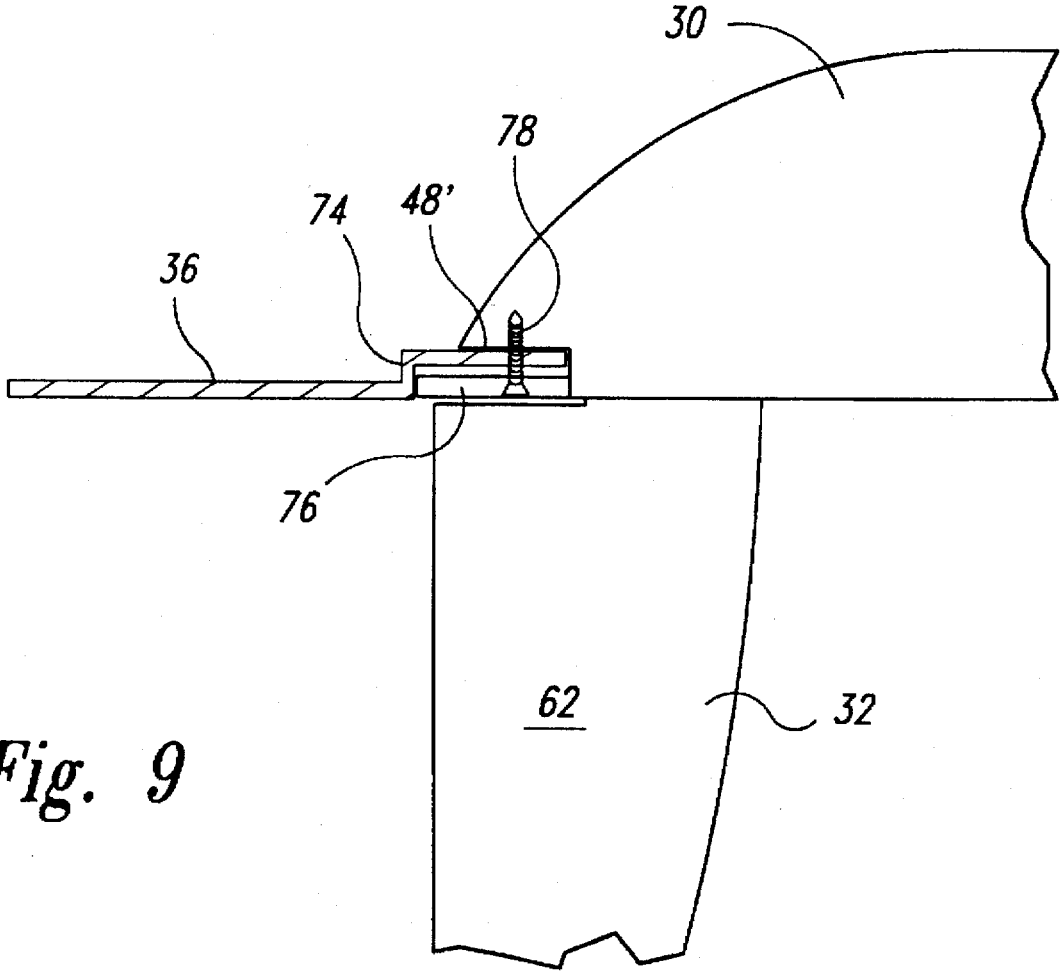
FIG. 9 is an enlarged side view of the tail section of FIG. 3, with another alternative design shown for mounting the skirt to the hull of the sailboard.

FIG. 9 illustrates a third alternative design for securing skirt 36 to board 30. With this design, skirt 36 is provided with a jog 74 and notch 48' is slightly deeper than notch 48 of the designs of FIGS. 7 and 8. An elongated rectangular clamp plate 76 fits within notch 48' and clamps the forward edge portion of skirt 36 to board 30 by means of one or more screws 78. In the alternative designs illustrated in FIGS. 7–9, it can be seen that the bottom surface of skirt 36 is mounted in such a manner that it is flush with the bottom surface of board 30. Likewise, in the design of FIG. 9, the bottom surface of clamp plate 76 is also flush with the bottom surface of skirt 36 and the bottom surface of board 30. By providing a smooth surface that moves across the water, this design does not increase drag.

The skirt of the present invention allows the trailing edge of the fin to be moved aft to the tail edge of the board without inducing ventilation. The skirt must extend from the back of the board far enough that the distance from the trailing edge of the fin to the trailing edge of the skirt is not less than three inches, and preferably four or more inches. The width of the skirt should be as great as practical for any given board design. However, it should be centered on the tail of the board and should be of a width not less than approximately six inches. This provides sufficient surface area around fin 32 to prevent ventilation.

Testing of the sailboard design of the present invention suggests that a course-slalom board fitted with the anti-ventilation skirt of the present invention can gain as much as two hundred yards to windward over a conventional board on a 1.5 mile beat. This is a significant improvement in windward performance that should promote innovative redesigns of many conventional sailboards. Such designs should be shorter, lighter and more efficient than boards currently being used.

While the majority of the foregoing description has been of a sailboard for the sport of windsurfing, it is believed that the present invention has utility with surfboards as well. Thus, the present invention is meant to include surfboard applications.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalents and reversal of parts.

What is claimed is:

1. A sailboard comprising a hull having a tail section, the tail section having a tail edge, a fin mounted to the bottom of the hull at the tail section, and a skirt extending aft of the tail section, wherein the skirt is flexible so that it assumes the contour of the water line as the pitch of the sailboard changes as the sailboard bounces across the water, and wherein the skirt has sufficient strength to prevent ventilation in the region of the fin.

2. The sailboard of claim 1, wherein the trailing edge of the root of the fin is positioned approximately three inches or less from the tail edge of the hull, and the skirt has sufficient surface area so that the trailing edge of the root of the fin is no closer than approximately three inches from the trailing edge of the skirt.

3. The sailboard of claim 1, wherein the skirt is substantially flush with the bottom surface of the hull.

4. The sailboard of claim 1, wherein the hull includes a notch at its tail edge, the notch adapted to receive a forward edge portion of the skirt for mounting the skirt to the hull surface so that the skirt is substantially flush with the bottom surface of the hull.

5. The sailboard of claim 4, and further comprising a clamp plate for clamping the forward edge portion of the skirt to the hull, the clamp plate sized to fill the portion of the notch not filled by the forward edge portion of the skirt, so that the clamp plate is substantially flush with the bottom surface of the hull.

6. The sailboard of claim 1, wherein the hull includes a slot adjacent its tail edge, the slot adapted to receive the forward edge portion of the skirt for mounting the skirt to the hull so that the skirt is substantially flush with the bottom surface of the hull.

7. The sailboard of claim 1, wherein the tail section of the hull is substantially squared off, and the skirt is secured to the tail edge of the hull in a manner that the trailing edge of the skirt continues the contours of the rails of the hull.

8. The sailboard of claim 1, wherein the fin includes a fin base and a foil, and the hull includes a fin box for receiving the fin base and securing the fin to the hull, the root of the foil extending aft of the back edge of the fin base.

9. The sailboard of claim 8, wherein the root of the foil extends aft of the fin base to approximately the tail edge of the hull.

10. A fin for use with a sailboard having a skirt extending from the tail edge of the sailboard, the sailboard including a fin box for mounting the fin to the sailboard, the fin comprising a fin base, and an entirely rigid foil;

the foil being off-set with respect to the fin base so that the trailing edge of the root of the foil is positioned aft of the fin base.

11. The sailboard of claim 1, wherein the flexible skirt is sufficiently flexible to assume the contour of the water line in a manner that does not affect the pitch of the sailboard.

12. A surfboard comprising a hull, a foil extending downwardly from the hull, and a skirt mounted to the hull adjacent to the foil, the skirt extending laterally from the foil in a manner so as to prevent ventilation in the region of the foil, wherein the skirt has sufficient flexibility so that the skirt assumes the contour of the water when the surfboard is used.

* * * * *